US010844748B2

(12) United States Patent
Imparato et al.

(10) Patent No.: US 10,844,748 B2
(45) Date of Patent: Nov. 24, 2020

(54) INNER CASING FOR STEAM TURBINE ENGINE

(71) Applicant: Nuovo Pignone SRL, Florence (IT)

(72) Inventors: Enzo Imparato, Sesto Florentino (IT); Marco Grilli, Pisa (IT); Enrico Giusti, Pistoia (IT)

(73) Assignee: Nuovo Pignone SRL, Florence (IT)

( * ) Notice: Subject to any disclaimer, the term of this patent is extended or adjusted under 35 U.S.C. 154(b) by 116 days.

(21) Appl. No.: 16/154,047

(22) Filed: Oct. 8, 2018

(65) Prior Publication Data

US 2019/0040763 A1 Feb. 7, 2019

Related U.S. Application Data

(63) Continuation of application No. 13/886,204, filed on May 2, 2013, now Pat. No. 10,094,245.

(30) Foreign Application Priority Data

Jan. 23, 2013 (IT) ..... CO2013A0001

(51) Int. Cl.
*F01D 25/26* (2006.01)
*F01D 1/02* (2006.01)
(Continued)

(52) U.S. Cl.
CPC ..... *F01D 25/26* (2013.01); *F01D 1/023* (2013.01); *F01D 1/16* (2013.01); *F01D 9/04* (2013.01);
(Continued)

(58) Field of Classification Search
CPC ..... F01D 25/24; F01D 25/26; F01D 25/265; F05D 2220/31
See application file for complete search history.

(56) References Cited

U.S. PATENT DOCUMENTS 2,147,874 A 2/1939 Zetterquist
2,211,874 A 8/1940 Wilson
(Continued)

FOREIGN PATENT DOCUMENTS

DE 1107243 B 5/1961
DE 2844681 B1 4/1980
(Continued)

OTHER PUBLICATIONS

Search Report and Written Opinion dated Aug. 5, 2013 from corresponding IT Application No. CO2013A000001.
(Continued)

*Primary Examiner* — Justin D Seabe
(74) *Attorney, Agent, or Firm* — Mintz Levin Cohn Ferris Glovsky and Popeo, P.C.

(57) ABSTRACT

A system includes a steam turbine. The steam turbine includes an outer casing and an inner casing disposed within the outer casing. The inner casing is horizontally split in an axial direction into an upper inner casing portion and a lower inner casing portion. The steam turbine also includes an impulse stage disposed within the inner casing, wherein the inner casing is configured to provide full arc admission of a fluid to the impulse stage. The steam turbine further includes at least one reaction stage having multiple blades. The at least one reaction stage is integrated within the inner casing.

19 Claims, 6 Drawing Sheets

(51) Int. Cl.

| | |
|---|---|
| ***F01D 1/16*** | (2006.01) |
| ***F01D 9/04*** | (2006.01) |
| ***F01D 17/18*** | (2006.01) |

(52) U.S. Cl.
CPC ..... *F01D 17/18* (2013.01); *F05D 2220/31* (2013.01)

(56) References Cited

U.S. PATENT DOCUMENTS

| | | | | |
|---|---|---|---|---|
| 2,243,959 | A * | 6/1941 | Hertl | F01D 25/26 415/190 |
| 2,308,897 | A | 1/1943 | Stearns | |
| 4,362,464 | A * | 12/1982 | Stock | F01D 25/26 415/108 |
| 4,393,658 | A | 7/1983 | Bohnenkamp et al. | |
| 5,152,664 | A | 10/1992 | Huang | |
| 5,411,365 | A | 5/1995 | Mazzola et al. | |
| 6,071,073 | A * | 6/2000 | Maier | F01D 25/24 29/525.01 |
| 6,773,227 | B2 | 8/2004 | Montgomery | |
| 10,094,245 | B2 | 10/2018 | Imparato et al. | |
| 2006/0273524 | A1 | 12/2006 | Weber et al. | |

FOREIGN PATENT DOCUMENTS

| | | | |
|---|---|---|---|
| DE | 290703 | C | 6/1991 |
| EP | 0043860 | A1 | 1/1982 |
| EP | 2078821 | A1 | 7/2009 |
| GB | 177491 | A | 11/1922 |
| GB | 662371 | A | 12/1951 |
| GB | 768069 | A | 2/1957 |
| GB | 912520 | A | 12/1962 |
| JP | S4982806 | A | 8/1974 |
| RU | 2069769 | C1 | 11/1996 |
| SU | 129660 | A1 | 11/1959 |

OTHER PUBLICATIONS

Cheski, Jeffrey R., et al.; "A Large Steam Turbine Retrofit Design and Operation History", Siemens AG 2005, pp. 1-19.

Smiarowski, Michael W.; "Turbine Modernization Projects at Susquehanna and Salem Nuclear Plants Maximize Performance at Current and Future Uprate Steam Conditions", Siemens Power Generation, PWR 2006-88237; Nov. 28-30, 2006, pp. 1-15.

Machine Translation and Notification of Reasons for Refusal issued in connection with corresponding JP Application No. 2015-553130 dated Oct. 10, 2017.

Office Action and Search issued in connection with corresponding RU Application No. 2015128287 dated Dec. 15, 2017.

* cited by examiner

INNER CASING FOR STEAM TURBINE ENGINE

CROSS-REFERENCE TO RELATED APPLICATION

This application is a continuation of U.S. patent application Ser. No. 13/886,204, filed May 2, 2013, titled "INNER CASING FOR STEAM TURBINE ENGINE," which claims priority to and benefit of Italian Patent Application No. CO2013A000001, entitled "INNER CASING FOR STEAM TURBINE ENGINE," filed Jan. 23, 2013, which are hereby incorporated by reference herein in their entireties.

BACKGROUND

The subject matter disclosed herein relates to steam turbine engines and, more specifically, to an inner casing for the steam turbine engines.

In certain applications, steam turbines may include various sections designed to be assembled during installation. For example, each steam turbine may include an outer casing and an inner casing disposed within the outer casing. Also, the steam turbine may include a reaction drum that includes multiple reaction stages, wherein the reaction drum can be integrated or separated from the inner casing. The inner casing can be partial arc or full admission belt of steam to an impulse stage. The assembly of these numerous components is costly. In addition, the assembly of these numerous components may limit the effectiveness of seals throughout the steam turbine (e.g., limiting balancing drum seal and steam recovery drum seal diameters).

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a steam turbine. The steam turbine includes an outer casing and an inner casing disposed within the outer casing. The inner casing is horizontally split in an axial direction into an upper inner casing portion and a lower inner casing portion. The steam turbine also includes an impulse stage disposed within the inner casing, wherein the inner casing is configured to provide full arc admission of a fluid to the impulse stage. The steam turbine further includes at least one reaction stage having multiple blades. The at least one reaction stage is integrated within the inner casing.

In accordance with a second embodiment, a system includes a steam turbine inner casing configured to be disposed within an outer casing of a steam turbine. The steam turbine inner casing is horizontally split in an axial direction into an upper inner casing having an upper flange portion and lower inner portion having a lower flange portion. The upper and lower flange portions form a horizontally split flange. The steam turbine inner casing is configured to be disposed about an impulse stage and to provide full arc admission of a fluid to the impulse stage.

The steam turbine inner casing is also configured to be integrated with and disposed about at least one reaction stage having multiple blades.

In accordance with a third embodiment, a system includes a steam turbine. The steam turbine includes an outer casing and a horizontally split inner casing disposed within the outer casing. The horizontally split inner casing includes an upper inner casing portion having an upper flange portion and a lower inner casing portion having a lower flange portion. The upper and lower flange portions form a horizontally split flange. The horizontally split inner casing also includes multiple steam ducts that define a fluid flow path through the upper and lower inner casing portions. The fluid flow path is configured to provide full arc admission of a fluid to an impulse stage via the fluid flow path. At least one steam duct includes an upper steam duct portion disposed in the upper inner casing portion and a lower steam duct portion disposed in the lower inner casing portion. The upper and lower steam duct portions form a sealed interface between the upper and lower flange portions to block leakage of fluid through the sealed interface. The sealed interface includes an annular seal disposed between the upper and lower steam duct portions and an anti-rotation mechanism disposed through a portion of the annular seal to block rotation of the annular seal relative to the upper and lower steam duct portions.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
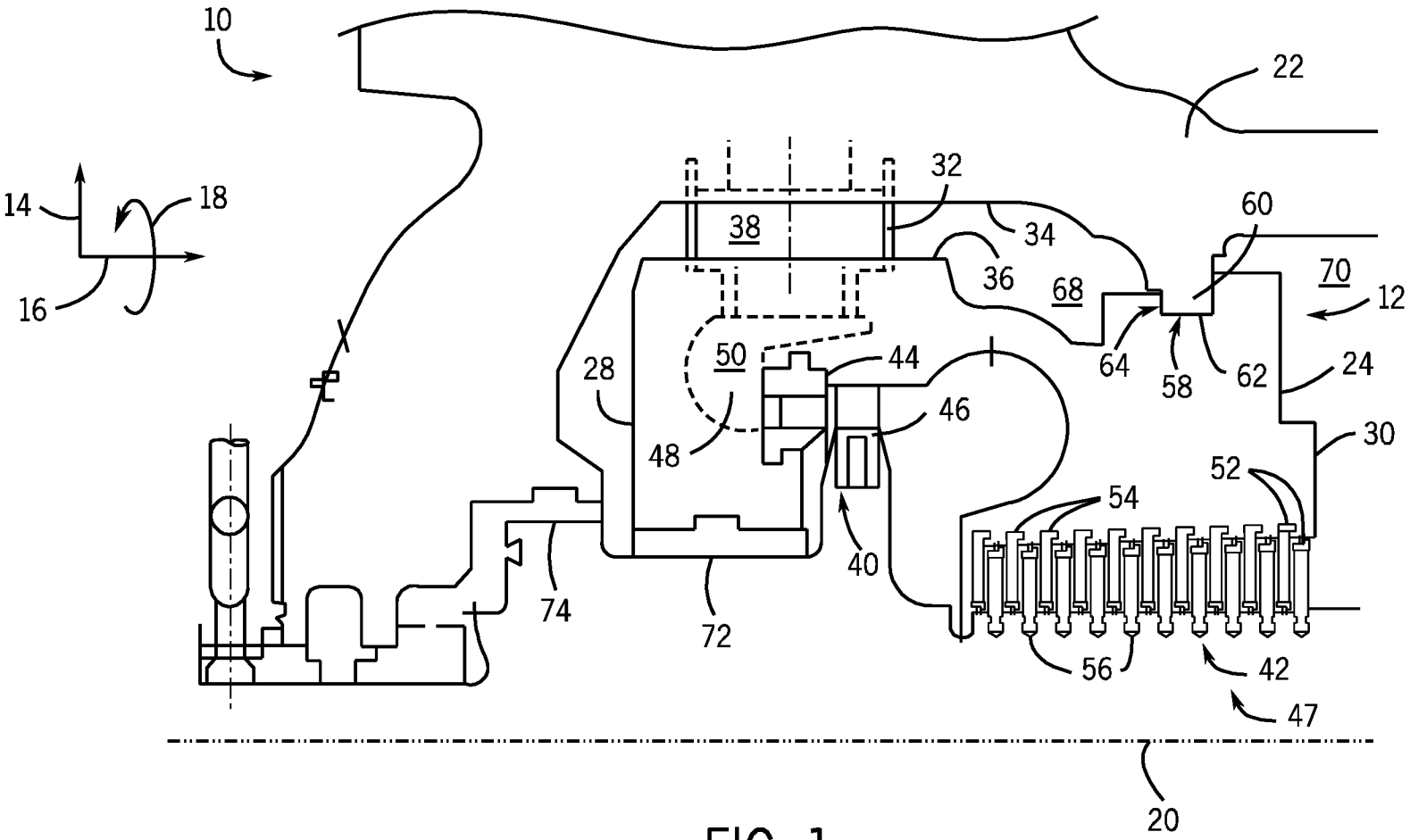
FIG. 1 is a cross-sectional side view of an embodiment of a portion of a steam turbine engine having a horizontally split inner casing.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed towards steam turbines (e.g., high pressure steam turbines using live steam up to approximately 140 bars) having a horizontally split inner casing. The steam turbine includes an outer casing and an inner casing disposed within the outer casing. The inner casing is horizontally split in an axial direction (e.g., along a horizontally split flange) into an upper inner casing portion (e.g., having an upper flange portion) and a lower inner casing portion (e.g., having a lower flange portion). The horizontally split flange may reduce costs associated with the assembly of the steam turbine, while enabling greater balancing drum seal and steam recovery drum seal diameters. The inner casing includes one or more reaction stages integrated within the inner casing. The integrated reactions stages may limit the pressure exerted on the outer casing. The steam turbine includes an impulse stage (e.g., set of moving blades disposed behind a nozzle) disposed within the inner casing upstream of the one or more reactions stages (e.g., alternating rows of stationary blades). The steam turbine also includes a plurality of steam ducts that a define a fluid flow path (e.g., steam flow path) through the upper and inner casing portions to provide full arc admission (e.g., admission of the fluid completely around the rotor or approximately 360 degrees of admission) of the fluid (e.g., steam) to the impulse stage. The full arc admission on the impulse stage minimizes stress on the rotary blades of the impulse stage while keeping high steam mass flow. In certain embodiments, one or more of the steam ducts (e.g., steam passages) include an upper steam duct portion (e.g., structure with steam passage) disposed in the upper inner casing and a lower steam duct portion (e.g., structure with steam passage) disposed in the lower inner casing portion that form a sealed interface between the upper and lower flange portions to block leakage of fluid through the sealed interface. In certain embodiments, the sealed interface includes an annular seal and an anti-rotation mechanism disposed through a portion of the annular seal to block rotation of the annular seal relative the upper and lower steam duct portions. The sealed interface may help drive the fluid (e.g., steam) toward the lower steam duct portions. In some embodiments, the inner casing includes a retainer (e.g., axial thrust retainer) that interfaces with a portion (e.g. protrusion) of the outer casing. In particular, an upper retainer portion (e.g., including a groove) may partially extend circumferentially relative to a rotational axis of the steam turbine about an outer surface of the upper inner casing portion. Also, a lower retainer portion (e.g., including a groove) may partially extend circumferentially relative to the rotational axis of the steam turbine about an outer surface of the lower inner casing portion. The retainer may block movement of the inner casing relative to the outer casing in response to axial force generated during operation of the steam turbine. In addition, the retainer enables fluid passage (e.g., steam) between the chambers of the steam turbine, thus, enabling steam seal recovery and increased turbine efficiency.

Turning now to the drawings, FIG. 1 is a cross-sectional side view of an embodiment of a portion of a steam turbine engine 10 (e.g., high pressure steam turbine) having a horizontally split inner casing 12. The steam turbine 10 may include a variety of components, some of which are not shown and/or discussed for the sake of simplicity. In the following discussion, reference may be made to a radial direction or axis 14, an axial direction or axis 16, and a circumferential direction or axis 18, relative to a longitudinal axis or rotational axis 20 of the turbine system 10. The horizontally split inner casing 12 and its associated features, as described in greater detail below, may reduce the costs of assembly of the steam turbine 10, while increasing the efficiency of the steam turbine 10 by enhancing the balancing drum 74 and steam recovery drum 72 seals to block fluid (e.g., steam) leaks.

The steam turbine 10 includes an outer casing 22 and the inner casing 12 disposed within the outer casing 22. The inner casing 12 generally has a barrel shape or hollow annular shape. The inner casing 12 is horizontally split in the axial direction 16 into an upper inner casing portion 24 (e.g., half or semi-cylindrical portion) and a lower inner casing portion 26 (e.g., half or semi-cylindrical portion, see FIG. 2). As described, in greater detail below, the upper inner casing portion 24 includes an upper flange portion 76 and the lower inner casing portion 26 includes a lower flange portion 82 that together form a horizontally split flange 88 in the axial direction 16. The horizontally split inner casing 22 and flange may reduce the costs of assembling the steam turbine 10, while enhancing the balancing drum seal system. The upper and lower inner casing portions 24, 26 each include an upstream portion 28 and a downstream portion 30 (e.g., barrel portion, see FIG. 2). A seal 32 (e.g., annular seal) extends between an inner surface 34 of the outer casing 22 and an outer surface 36 of the upstream portion 36 of the upper inner casing 24. The seal 32 defines a passage 38 for a fluid (e.g., steam to flow from the outer casing 22 into the inner casing 12.

The upstream portion 28 of the inner casing 12 is disposed about an impulse stage 40 (e.g., high pressure impulse stage) located upstream of a plurality of reaction stages 42 integrated within (i.e., part of) the downstream portion 30 of the inner casing 12. The impulse stage 40 includes one or more nozzles 44 and one or more rows of moving or rotary blades 46 coupled to a rotating component 47 (e.g. shaft or rotor) that rotates about the rotational axis 20. The inner casing 12 includes a plurality of steam ducts 48 (e.g., inner ducts) that define a fluid flow path 50 (e.g., steam flow path) through the upper and inner casing portions 24, 26 to provide full arc admission (e.g., approximately 360 degrees) of the fluid (e.g., steam) to the impulse stage 40. The full arc admission on the impulse stage 40 may minimize stress on the rotary blades 46. In certain embodiments, one or more the steam ducts 48 includes an upper steam duct portion 112, 114 disposed in the upper inner casing portion 24 and a lower steam duct portion 116, 118 disposed in the lower inner casing portion 26. The upper and lower inner steam duct portions 112, 114, 116, 118 may form a sealed interface 126 (e.g., where the flange 88 splits) to block leakage of steam through the sealed interface 126. As described in greater detail below, the sealed interface 126 may include an annular seal 128 and an anti-rotation mechanism 136 to block rotation of the annular seal 128 relative to the upper and lower duct portions 112, 114, 116, 118. The seal system on the horizontally split flange 88 may drive the fluid (e.g., steam) on the lower steam duct portions 116, 118.

As mentioned above, the plurality of reaction stages 42 are integrated within (i.e., part of) the downstream portion 30 of the inner casing 12. The downstream portion 30 of inner casing 12 is disposed circumferentially 18 (e.g., approximately 360 degrees) about the plurality of reaction stages 42 including a plurality of blades 52. Specifically, moving blades 54 are attached to the rotating element 47 and stationary blades 56 are attached to the inner casing 12. The moving blades 54 and the stationary blades 56 are arranged alternatively in the axial direction 16, wherein each row includes one or more of either the moving blades 54 or stationary blades 56. The integration of the plurality of reaction stages 42 within the inner casing 12 may limit the pressure exerted on the outer casing 22.

The inner casing 12 also includes a retainer 58 that interfaces with a portion 60 (e.g., protrusion) of the outer casing 22 that extends from the inner surface 34. The retainer 58 includes a groove 62 (e.g., u-shaped groove) that receives the protrusion 60 of the outer casing 22. The groove 62 interfaces with the protrusion 60 to block movement of the inner casing 12 relative to the outer casing 22 in response to an axial force generated during the operation of the steam turbine 10. In particular, the groove 62 partially surrounds the protrusion 60 to block movement of the inner casing 12 in the axial direction 16. In certain embodiments, the retainer 58 includes an upper retainer portion 64 (see FIG. 2) that partially extends circumferentially 18 relative to the rotational axis 20 of the steam turbine 20 about the outer surface 36 of the downstream portion 30 of the upper inner casing portion 24. The retainer 58 includes a lower retainer portion 66 (see FIG. 2) that partially extends circumferentially 18 relative to the rotational axis 20 of the steam turbine 10 about an outer surface of the downstream portion 30 of the lower inner casing portion 24. The inner casing 12 and the outer casing 22 define a plurality of chambers, e.g., upstream chamber 68 and downstream chamber 70. The protrusion 60 disposed within the retainer 58 separates the chambers 68, 70 from each other. Since the retainer 58 (e.g. upper and lower retainer portions 64, 66) only partially extend circumferentially 18 around the inner casing 12, fluid (e.g., steam) may pass between the chambers 68, 70. The passing of fluid between these chambers 68, 70 may enhance steam seal recovery and increase turbine efficiency.

Additional components of the steam turbine 10 include a steam recovery drum 72 and a balancing drum 74. The upstream portion 28 of the inner casing 12 is circumferentially 18 disposed about the steam recovery drum 72. The balancing drum 74 is located axially 16 upstream of the inner casing 12. The balancing drum 74 maintains the balance of the rotating component 47 of the steam turbine 10 via regulation of pressure (e.g., back pressure). As mentioned above, the horizontally split inner casing 12 and its associated features may reduce the costs of assembly of the steam turbine 10, while increasing the efficiency of the steam turbine 10 by enhancing the balancing drum 74 and steam recovery drum 72 seals to block fluid (e.g., steam) leaks.

Fluid (e.g., high pressure steam) flows from the outer casing 22 to the inner casing 12 through passage 38 into the fluid flow path 50 defined by the steam ducts 48 within the inner casing 12. The pressurized fluid in the fluid flow path 50 is provided via full arc admission to the impulse stage 40, where the one or more nozzles 44 direct the fluid onto the moving blades 46. As the fluid travels through the nozzles 44 it loses pressure but increases in velocity. The motive force of the fluid from the nozzles 44 causes the moving blades to rotate about the rotating component 47 and the rotational axis 20. Overall the fluid increases in net velocity as it exits the impulse stage 40. The fluid travels from the impulse stage 40 to the plurality of reaction stages 42. The fluid alternately travels through the stationary and moving blades 54, 56 of the reaction stages 42. The stationary blades 54 direct the fluid flow towards the moving blades 56. The motive force from the directed flow results in the rotation of the moving blades circumferentially 18 about the rotating component 47 and the rotational axis 20. After passing through the plurality of reactions stages 42, the fluid exits the inner casing 12 of the steam turbine 10.

Figure 2:
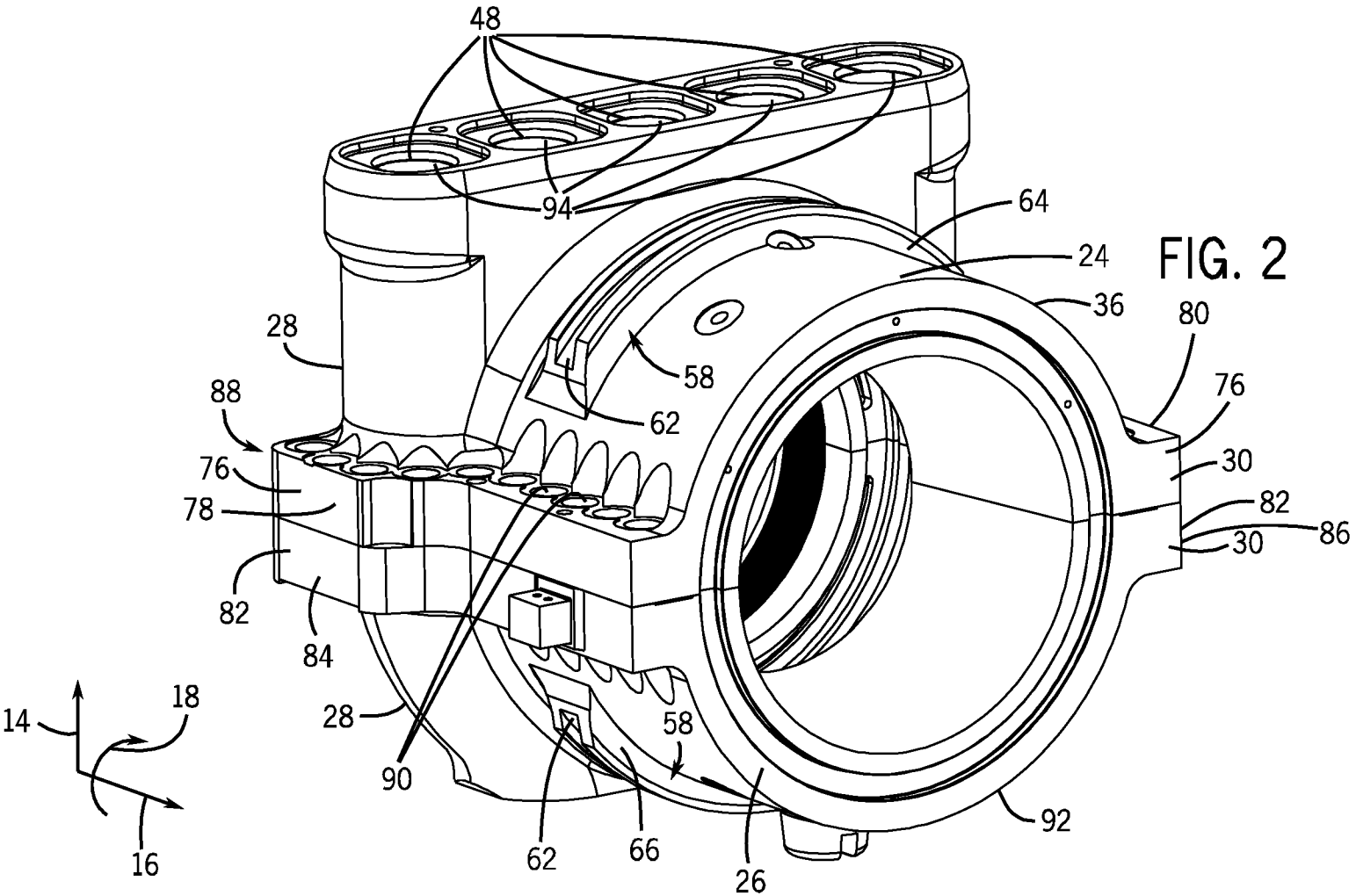
FIG. 2 is a perspective view of an embodiment of the horizontally split inner casing of FIG. 1.
Figure 4:
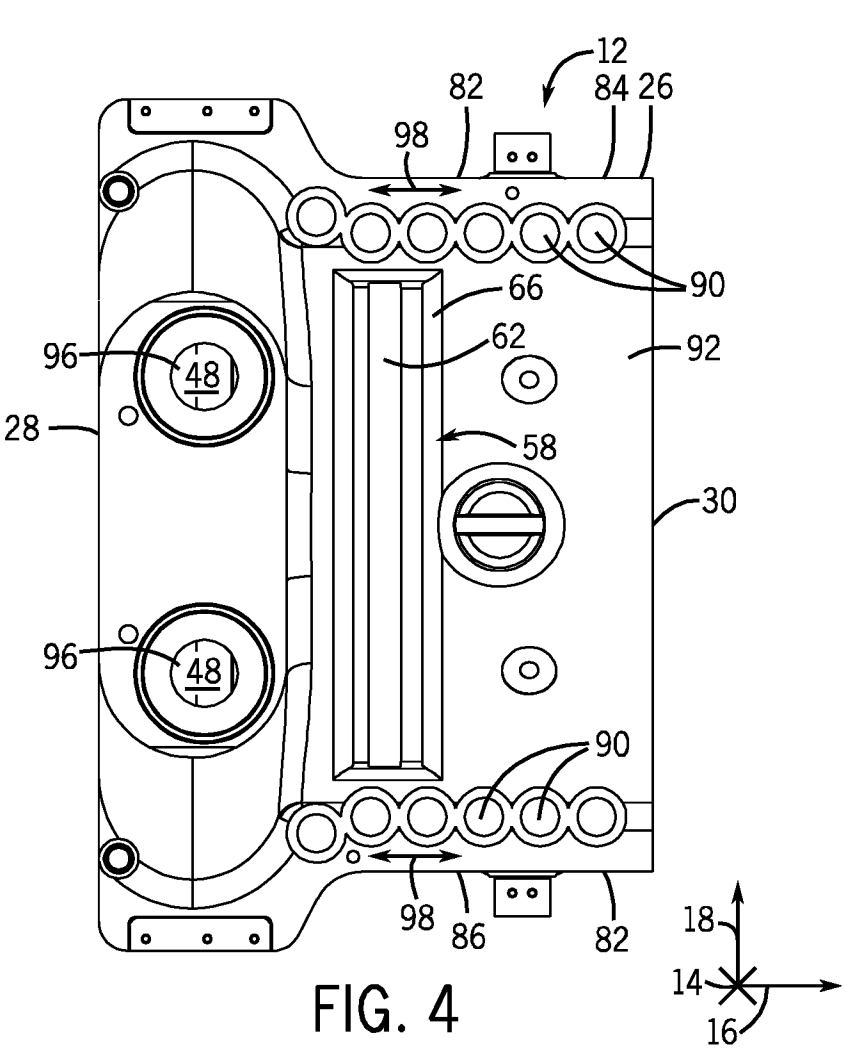
FIG. 4 is a bottom view of an embodiment of the horizontally split inner casing of FIG. 2.
Figure 3:
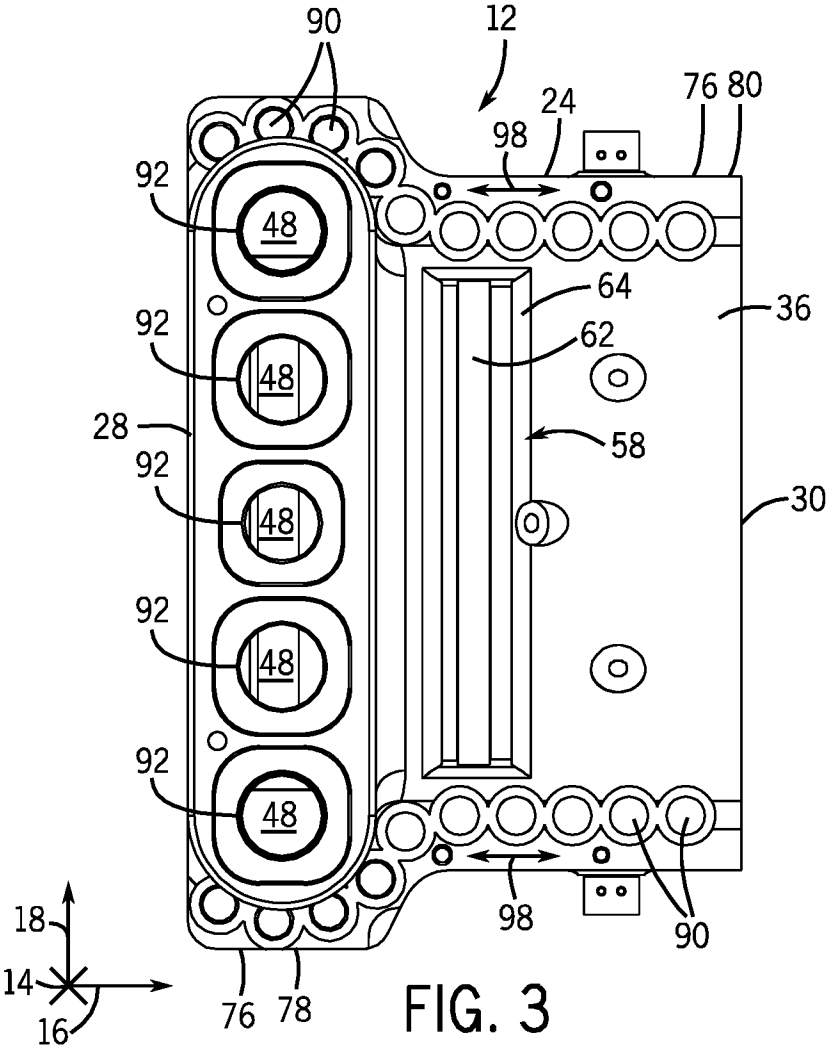
FIG. 3 is a top view of an embodiment of the horizontally split inner casing of FIG. 2.

FIGS. 2-4 are perspective, top, and side views, respectively, of an embodiment of the horizontally split inner casing 12 of FIG. 1. In general, the inner casing 12 is as described above in FIG. 1. The inner casing 12 generally has a barrel shape or hollow annular shape (especially, the downstream portion 30). The inner casing 12 is horizontally split in the axial direction 16 into the upper inner casing portion 24 and the lower inner casing portion 26. The upper inner casing portion 24 includes an upper flange portion 76 that extends radially 14 out from sides 78, 80 of the upper inner casing portion 24 along the axial axis 16. The lower inner casing portion 26 includes a lower flange portion 82 that extends radially 14 out from sides 84, 86 of the lower inner casing portion 26 along the axial axis 16. Together, the upper and lower flange portions 76, 82 form a horizontally split flange 88 in the axial direction 16. As mentioned above, the horizontally split inner casing 12 and flange 88 may reduce the costs of assembling the steam turbine 10, while enhancing the balancing drum seal system. The upper and lower flange portions 76, 82 include corresponding openings 90 for fasteners (e.g., male and female fasteners) to be used to secure the flange portions 76, 82 (and the upper and lower inner casing portions 24, 26) together. In certain embodiments, the fasteners may include tie rods and stud bolts.

The upper and lower inner casing portions 24, 26 each include the upstream portion 28 and the downstream portion 30. The upstream portion 28 of each respective inner casing portion 24, 26 radially 14 extends outward from the respective outer surfaces 36, 92 of each respective inner casing portion 24, 26. The upstream portions 28 of the upper and lower inner casing portion 24, 26 house the plurality of steam ducts 48 (see FIG. 5) that define the fluid (e.g., steam) flow path 50 that provides the full arc admission of the fluid to the impulse stage 40. The upper inner casing portion 24 includes openings 94 for the fluid to enter into the steam ducts 48 and the inner casing 12. The number of openings 94 may range from 1 to 10 or more. As depicted in FIGS. 2 and 3, the upper inner casing portion 24 includes 5 openings 92. The lower inner casing portion 26 includes openings 96 for the fluid to exit the steam ducts 48 and the inner casing 12. The number of openings 96 may range from 1 to 10 or more. As depicted in FIGS. 3 and 4, the lower inner casing portion 26 includes 2 openings 94.

As mentioned above, the inner casing 12 also includes the retainer 58 that interfaces with the portion 60 (e.g., protrusion) of the outer casing 22 that extends from the inner surface 34. The retainer 58 includes the groove 62 (e.g., u-shaped groove) that receives the protrusion 60 of the outer casing 22. The groove 62 interfaces with the protrusion 60 to block movement of the inner casing 12 relative to the outer casing 22 in response to an axial force generated during the operation of the steam turbine 10. In particular, the groove 62 partially surrounds the protrusion 60 to block movement of the inner casing 12 in the axial direction 16. As depicted in FIGS. 2 and 3, the retainer 58 includes the upper retainer portion 64 that partially extends circumferentially

18 relative to the rotational axis 20 (see FIG. 1) of the steam turbine 20 about the outer surface 92 of the downstream portion 30 (e.g., barrel-shaped portion) of the upper inner casing portion 24. As depicted in FIGS. 2 and 4, the retainer 58 includes the lower retainer portion 66 (see FIG. 2) that partially extends circumferentially 18 relative to the rotational axis 20 (see FIG. 1) of the steam turbine 20 about the outer surface 92 of the downstream portion 30 (e.g., barrel portion) of the lower inner casing portion 24. The inner casing 12 and the outer casing 22 define upstream chamber 68 and downstream chamber 70 (see FIG. 1). The protrusion 60 disposed within the retainer 58 separates the chambers 68, 70 from each other. Since the retainer 58 (e.g., upper and lower retainer portions 64, 66) only partially extend circumferentially 18 around the inner casing 12, fluid (e.g., steam) may pass between the chambers 68, 70 around the periphery of the upper and lower retainer portions 64, 66 as indicated by arrows 98 (see FIGS. 3 and 4). The passing of fluid between these chambers 68, 70 may enhance steam seal recovery and increase turbine efficiency.

Figure 5:
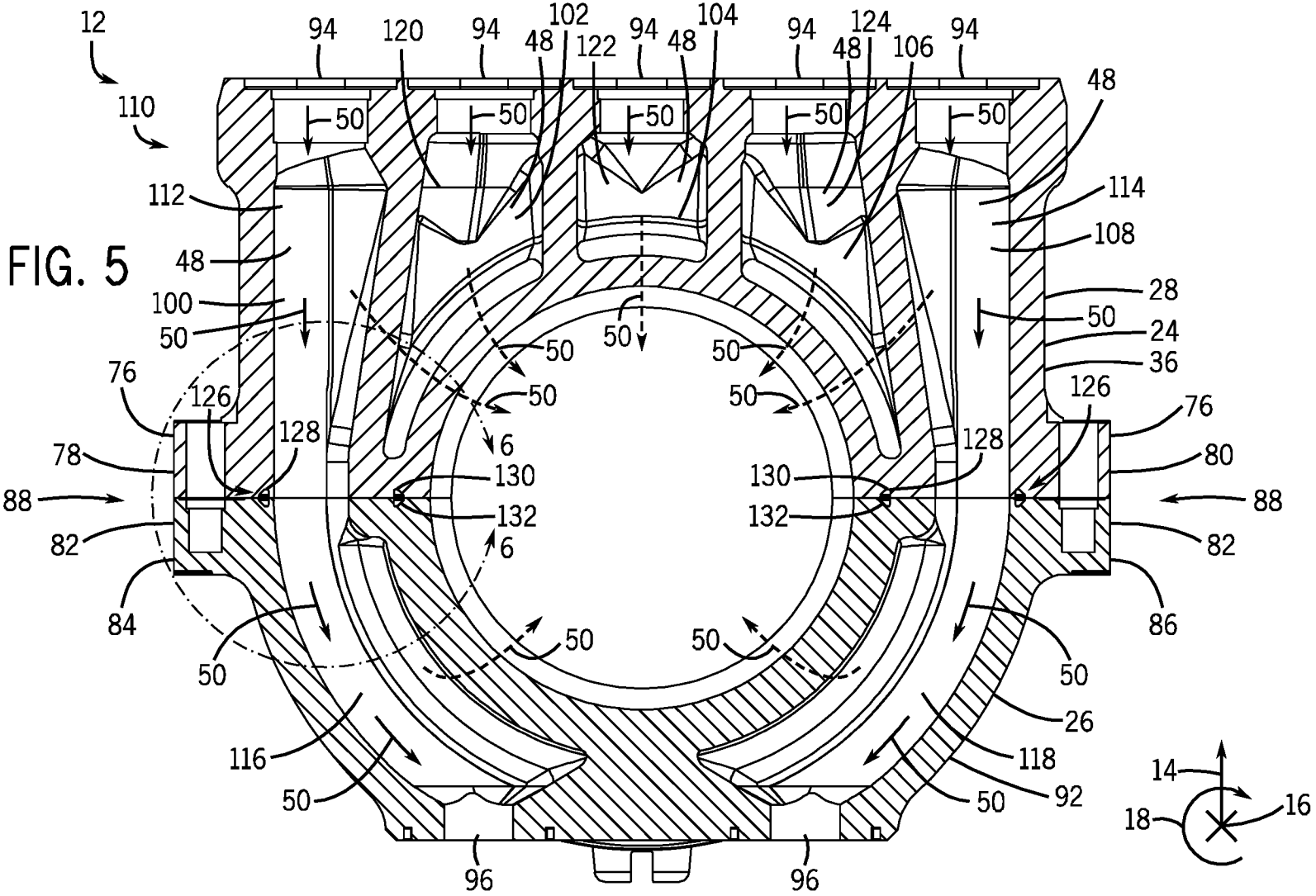
FIG. 5 is a cross-sectional view of an embodiment of the horizontally split inner casing, taken along line 5-5 of FIG. 2, illustrating steam ducts disposed within inner casing.

FIG. 5 is a cross-sectional view of an embodiment of the horizontally split inner casing 12, taken along line 5-5 of FIG. 2, illustrating the steam ducts 48 disposed within inner casing 12. In general, the inner casing 12 is as described above in FIGS. 1-4. The inner casing 12 may include 1 to 10 or more steam ducts. As depicted, the inner casing includes 5 steam ducts 48 (e.g., steam ducts 100, 102, 104, 106, 108). The plurality of steam ducts 48 defines the fluid flow path 50 (e.g., steam flow path) through the upper and inner casing portions 24, 26 to provide full arc admission (e.g., approximately 360 degrees) of the fluid (e.g., steam) to the impulse stage 40 (see FIG. 1). The full arc admission on the impulse stage 40 may minimize stress on the rotary blades 46. The steam ducts 100, 108 are disposed about a periphery 110 of the inner casing 12, while the steam ducts 102, 104, 106 are disposed between the steam ducts 100, 108. Steam ducts 100, 108 extend through the upper and lower inner casing portions 24, 26 of the upstream portion 28 of the inner casing 12. The steam ducts 100, 108 include respective upper steam duct portions 112, 114 and lower steam duct portions 116, 118 that provide fluid flow to the impulse stage 40 from both the upper and lower inner casing portions 24, 26. The upper steam duct portions 112, 114 also fluidly communicate with adjacent steam ducts 102, 104, 106 to provide fluid to these ducts 102, 104, 106 and subsequently to the impulse stage 40. Also, steam ducts 102, 104, 106 may provide fluid to steam ducts 100 and 108. The steam ducts 102, 104, 106 only include respective duct portions 120, 122, 124 disposed within the upper inner casing portion 24. Thus, the steam ducts 102, 104, 106 only provide fluid to the impulse stage 40 via the upper inner casing portion 24.

Figure 6:
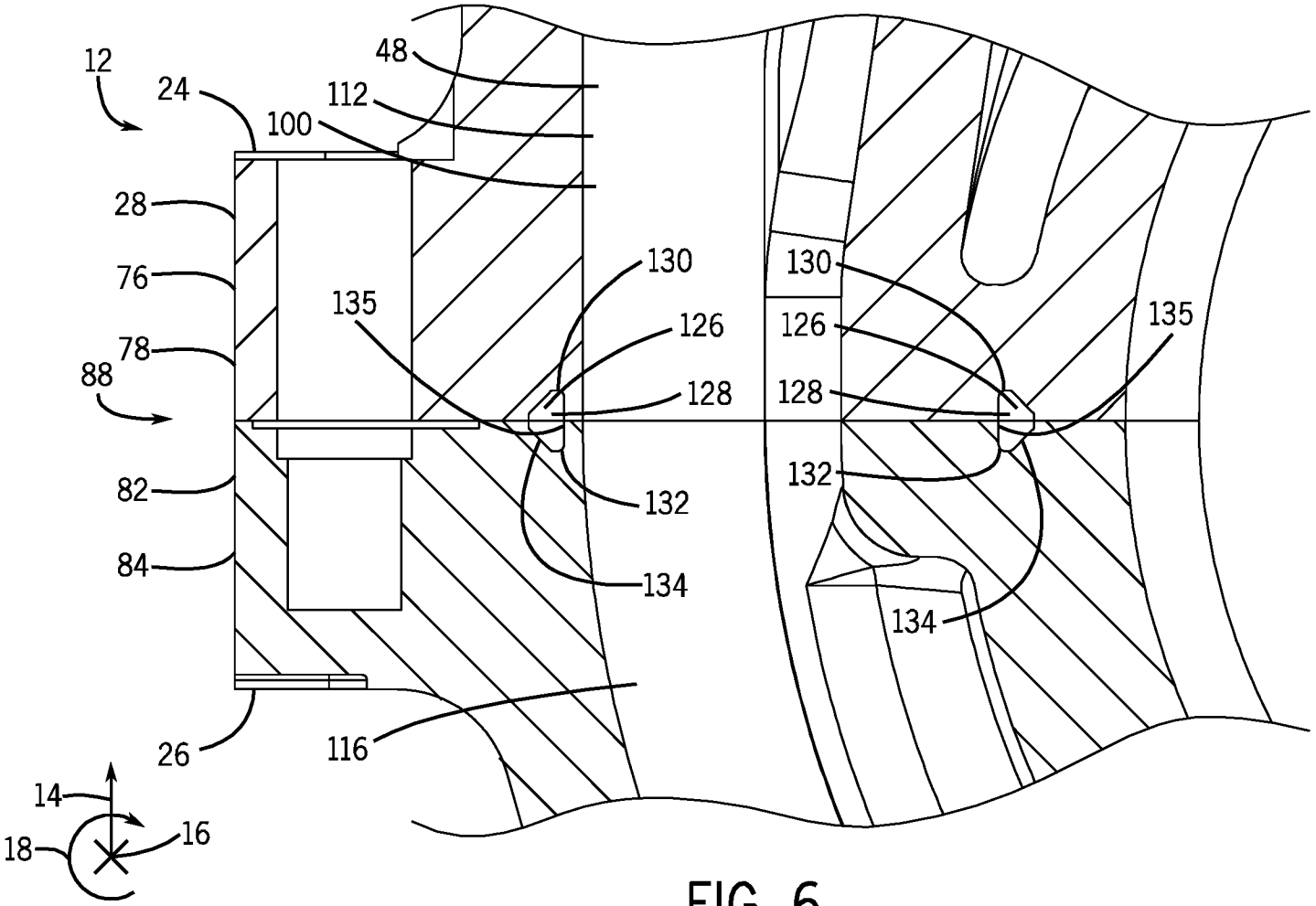
FIG. 6 is a partial cross-sectional view of an embodiment of the horizontally split inner casing, taken within line 6-6 of FIG. 5, illustrating a seal interface between upper and lower duct portions of one of the steam ducts.

The respective upper steam duct portions 112, 114 and lower steam duct portions 116, 118 of steam ducts 100, 108 each form a sealed interface 126 (e.g., where the flange 88 splits) to block leakage of fluid through the sealed interface 126 (see also FIG. 6 providing a detailed view taken within line 6-6 of FIG. 5). The sealed interface 126 includes a seal 128 (e.g., annular seal). The annular seal 128 is disposed between recesses or grooves 130, 132 (e.g., annular recesses or grooves) within the upper and lower inner casing portions 24, 26. The annular seal 128 includes a semi-elliptical (e.g., semi-circular) periphery 134. Differences in pressure between within and outside the steam ducts 100, 108 forces the annular seal 128 (e.g., periphery 134) towards the outside 135 (i.e., away from the ducts 100, 108) of the recesses 130, 132. The annular seal 128 may be made of carbon, graphite, carbon-graphite, or any other material able to withstand the temperature and pressure of the high pressure steam turbine 10. As described in greater detail below, the sealed interface includes an anti-rotation mechanism to block rotation of the annular seal 128 relative to the upper 112,114 and lower 116, 118 steam duct portions. The seal system (e.g., sealed interface 126) on the horizontally split flange 88 may drive the fluid (e.g., steam) on the lower steam duct portions 116, 118.

Figure 7:
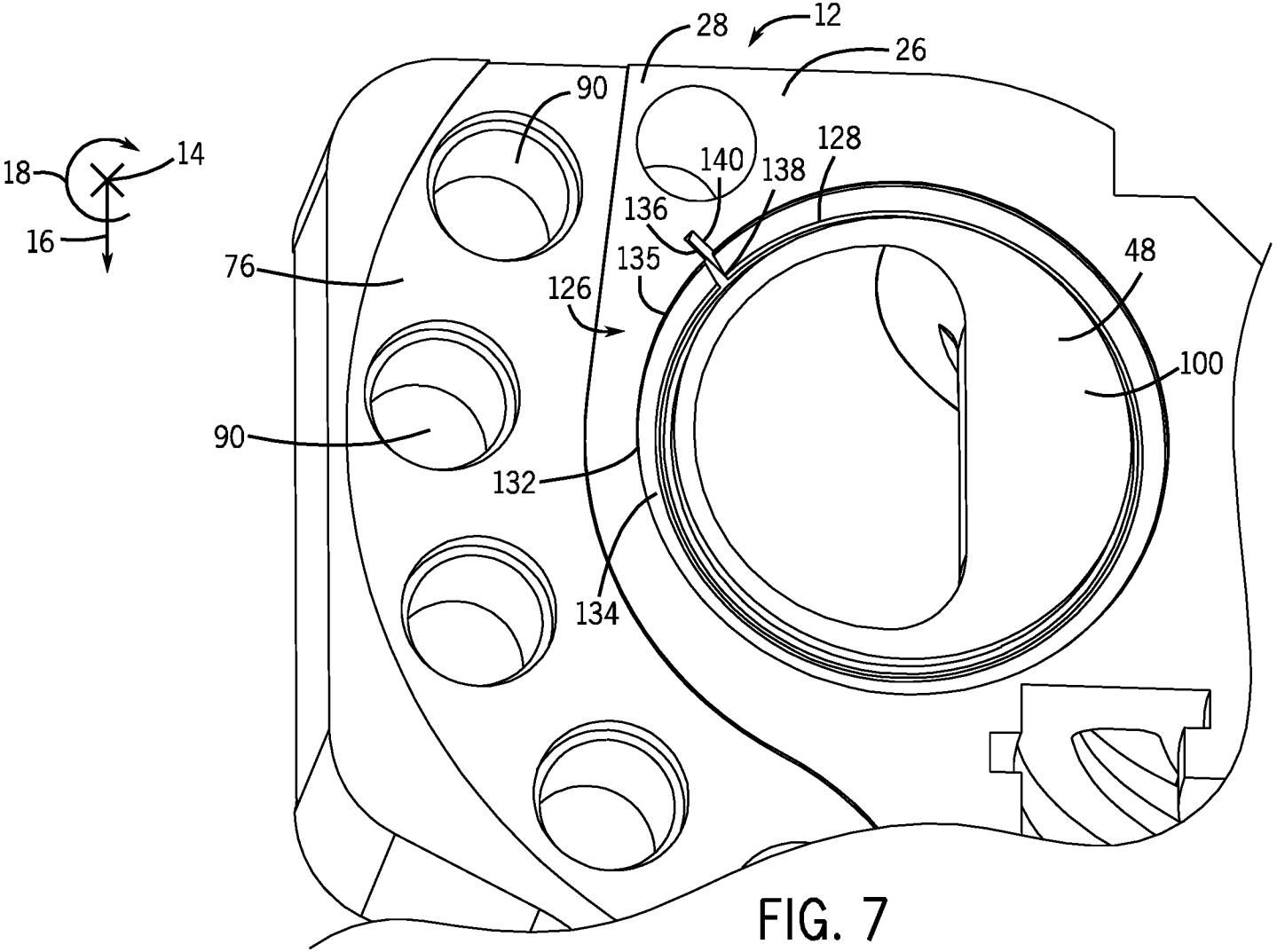
FIG. 7 is a partial perspective top view of an embodiment of the seal interface disposed on a lower portion of the horizontally split inner casing having an annular seal and an anti-rotation mechanism.

FIG. 7 is a partial perspective top view of an embodiment of the seal interface 126 disposed on the lower inner casing portion 26 of the horizontally split inner casing 12 having the annular seal 128 and an anti-rotation mechanism 136. As depicted, the annular seal 128 is depicted for steam duct 100. In particular, the annular seal 128 is disposed in the recess or groove 132 (e.g., annular recess or groove). Similarly, the annular seal 128 also fits into the recess or groove 130 of the upper inner casing portion 24. Also, another annular seal 128 may also fit in the recess or groove 130 (e.g., annular recess or groove) of the upper inner casing portion 26 that defines steam duct 100. The annular seal 128 is as described above in FIGS. 5 and 6. In addition, the annular seal 128 includes a recess 138 for receiving the anti-rotation mechanism 136. The lower inner casing portion 26 includes a recess 140 adjacent (and aligned with) the recess 138 for receiving the anti-rotation mechanism 136. The anti-rotation mechanism 136 (e.g., pin) is inserted into the recesses 138, 140, so that the mechanism 136 is disposed through a portion of the annular seal 128 to block circumferential 18 movement of the annular seal 128 relative to the upper and lower steam duct portions 112, 116 (see FIGS. 5 and 6). In certain embodiments, the seal interface 126 may include more than one anti-rotation mechanism 136 and corresponding recesses 138, 140 for each annular seal 128. For example, each seal interface 126 may include 1 to 5 or more anti-rotation mechanisms 136 and corresponding recesses 138, 140. Similarly, the annular ring 128 as depicted in FIG. 7 may fit in similar recesses or grooves 130, 132 of the upper and lower inner casing portions 24, 26 that define steam duct 108 (see FIG. 5). In addition, the rest of the seal interface 126 and the anti-rotation mechanism 136 may be similar for steam duct 108. As mentioned above, the seal system (e.g., sealed interface 126) on the horizontally split flange 88 may drive the fluid (e.g., steam) on the lower steam duct portions 116, 118.

Technical effects of the disclosed embodiments include providing the horizontally split inner casing 12 for a high pressure steam turbine 10. The inner casing 12 includes features to reduce the costs of assembly of the steam turbine 10, while increasing the efficiency of the steam turbine 10 by enhancing the balancing drum 74 and steam recovery drum 72 seals to block fluid (e.g., steam) leaks. For example, the inner casing 12 enables full arc admission to the impulse stage 40 to minimize stress on the rotary blades 46. The inner casing 12 also enables the integration of the plurality of reaction stages 42 within the inner casing 12 to limit pressure on the outer casing 22. In addition, the inner casing 12 includes a seal system on the horizontally split flange 88 to drive steam on the lower portions of the steam ducts 48.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A steam turbine, comprising:

an outer casing;

an inner casing disposed within the outer casing, wherein the inner casing is horizontally split in an axial direction into an upper inner casing portion and a lower inner casing portion, wherein the inner casing includes a retainer that interfaces with a portion of the outer casing to block movement of the inner casing relative to the outer casing in response to an axial force generated during operation of the steam turbine, and wherein the inner casing includes a flange comprising an upper flange portion and a lower flange portion; and at least one steam duct comprising an upper stream duct portion disposed in the upper inner casing portion and a lower steam duct portion disposed in the lower inner casing portion, the at least one steam duct configured to form a sealed interface between the upper and lower flange portions to block leakage of fluid through the sealed interface, the sealed interface comprising an annular seal ring and an anti-rotation mechanism including a first end disposed within a first recess of the annular seal ring and a second end disposed within a second recess of the lower inner casing portion, wherein the first recess and the second recess are aligned with respect to one another, the anti-rotation mechanism configured to block rotation of the annular seal ring relative to the upper and lower steam duct portions, wherein the anti-rotation mechanism extends radially away from the annular seal ring toward an upstream portion of the lower inner casing portion.

2. The steam turbine of claim 1, further comprising at least one reaction stage comprising a plurality of blades integrated within the inner casing.

3. The steam turbine of claim 2, further comprising at least one impulse stage disposed within the inner casing upstream of the at least one reaction stage.

4. The steam turbine of claim 1, wherein the retainer comprises an upper retainer portion that partially extends circumferentially relative to a rotational axis of the steam turbine about a first outer surface of the upper inner casing portion, and a lower retainer portion that partially extends circumferentially relative to the rotational axis about a second outer surface of the lower inner casing portion.

5. The steam turbine of claim 4, wherein the upper and lower retainer portions each form a groove configured to receive respective portions of the outer casing.

6. A steam turbine, comprising:

an inner casing disposed within an outer casing, wherein the inner casing is horizontally split in an axial direction into an upper inner casing portion including an upper flange portion and a lower inner casing portion including a lower flange portion, the inner casing including a plurality of steam ducts that define a fluid flow path through the upper and lower inner casing portions, at least one of the plurality of steam ducts including an upper steam duct portion disposed in the upper inner casing portion and a lower steam duct portion disposed in the lower inner casing portion;

wherein the upper steam duct portion and the lower steam duct portion form a sealed interface between the upper and lower flange portions to block leakage of fluid through the sealed interface, the sealed interface comprising an annular seal disposed between the upper and lower steam duct portions and an anti-rotation mechanism including a first end disposed within a first recess of the annular seal and a second end disposed within a second recess of the lower inner casing portion, wherein the first recess and the second recess are aligned with respect to one another, the anti-rotation mechanism configured to block rotation of the annular seal relative to the upper and lower steam duct portions, wherein the anti-rotation mechanism extends radially away from the annular seal ring toward an upstream portion of the lower inner casing portion.

7. The steam turbine of claim 6, further comprising:

an impulse stage disposed within the inner casing, wherein the inner casing is configured to provide full arc admission of the fluid to the impulse stage via the fluid flow path; and at least one reaction stage comprising a plurality of blades, wherein the at least one reaction stage is integrated within the inner casing.

8. The steam turbine of claim 7, wherein the impulse stage is disposed within the inner casing upstream of the at least one reaction stage.

9. The steam turbine of claim 7, wherein the upper flange portion and the lower flange portion form a flange.

10. The steam turbine of claim 6, wherein the inner casing comprises a retainer that interfaces with a portion of the outer casing to block movement of the inner casing relative to the outer casing in response to an axial force generated during operation of the steam turbine.

11. The steam turbine of claim 10, wherein the retainer comprises an upper retainer portion that partially extends circumferentially relative to a rotational axis of the steam turbine about a first outer surface of the upper inner casing portion, and a lower retainer portion that partially extends circumferentially relative to the rotational axis about a second outer surface of the lower inner casing portion.

12. The steam turbine of claim 11, wherein the upper and lower retainer portions each form a groove configured to receive respective portions of the outer casing.

13. A steam turbine, comprising:

an inner casing disposed within an outer casing, wherein the inner casing is horizontally split in an axial direction into an upper inner casing portion having an upper flange portion and a lower inner casing portion having a lower flange portion; and a plurality of steam ducts disposed within the inner casing, at least one of the plurality of steam ducts forming a sealed interface, the sealed interface comprising an annular seal disposed between the upper and lower steam duct portions, and the sealed interface comprising an anti-rotation mechanism including a first end disposed within a first recess of the annular seal and a second end disposed in a second recess of the lower inner casing portion, wherein the first recess and the second recess are aligned with respect to one another, the anti-rotation mechanism configured to block rotation of the annular seal relative to the upper and lower steam duct portions, wherein the anti-rotation mechanism extends radially away from the annular seal ring toward an upstream portion of the lower inner casing portion.

14. The steam turbine of claim 13, wherein the steam turbine inner casing is configured to be disposed about an impulse stage and to provide full arc admission of a fluid to the impulse stage, and the steam turbine inner casing is configured to be integrated with and disposed about at least one reaction stage having a plurality of blades.

15. The steam turbine of claim 14, wherein the steam turbine inner casing is configured to be disposed about the impulse stage upstream of a location of the at least one reaction stage.

16. The steam turbine of claim 14, wherein the plurality of steam ducts define a fluid flow path through the upper and lower inner casing portions, and the fluid flow path is configured to provide full arc admission of a fluid to the impulse stage via the fluid flow path.

17. The steam turbine of claim 13, wherein at least one steam duct of the plurality of steam ducts comprises an upper steam duct portion disposed in the upper inner casing portion and a lower steam duct portion disposed in the lower inner casing portion, and the upper steam duct portion and the lower steam duct portion form the sealed interface between the upper and lower flange portions to block leakage of fluid through the sealed interface.

18. The steam turbine of claim 13, wherein the steam turbine inner casing comprises a retainer that interfaces with a portion of the outer casing to block movement of the steam turbine inner casing relative to the outer casing in response to an axial force generated during operation of the steam turbine.

19. The steam turbine of claim 18, wherein the retainer comprises an upper retainer portion that partially extends circumferentially relative to a rotational axis of the steam turbine about a first outer surface of the upper inner casing portion, and a lower retainer portion that partially extends circumferentially relative to the rotational axis about a second outer surface of the lower inner casing portion.

* * * * *